US010662540B2

(12) United States Patent
Abbott et al.

(10) Patent No.: US 10,662,540 B2
(45) Date of Patent: May 26, 2020

(54) ELECTROLYTE FOR ELECTROPLATING

(71) Applicant: University of Leicester, Leicester (GB)

(72) Inventors: Andrew Peter Abbott, Leicester (GB); Karl Scott Ryder, Leicester (GB); Robert Harris, Leicester (GB)

(73) Assignee: University of Leicester, Leicester (GB)

( * ) Notice: Subject to any disclaimer, the term of this patent is extended or adjusted under 35 U.S.C. 154(b) by 204 days.

(21) Appl. No.: 15/548,067

(22) PCT Filed: Feb. 3, 2016

(86) PCT No.: PCT/GB2016/050248
§ 371 (c)(1),
(2) Date: Aug. 1, 2017

(87) PCT Pub. No.: WO2016/124921
PCT Pub. Date: Aug. 11, 2016

(65) Prior Publication Data

US 2018/0245227 A1 Aug. 30, 2018

(30) Foreign Application Priority Data

Feb. 3, 2015 (GB) ..... 1501751.0

(51) Int. Cl.

| | |
|---|---|
| ***C25D 3/04*** | (2006.01) |
| ***C25D 3/06*** | (2006.01) |
| ***C25D 3/10*** | (2006.01) |
| ***C25D 3/66*** | (2006.01) |
| ***C25D 5/04*** | (2006.01) |

(52) U.S. Cl.
CPC ..... *C25D 3/10* (2013.01); *C25D 3/06* (2013.01); *C25D 3/665* (2013.01); *C25D 5/04* (2013.01)

(58) Field of Classification Search
CPC ..... C25D 3/04; C25D 3/06; C25D 3/10
USPC ..... 205/283, 287, 290, 289
See application file for complete search history.

(56) References Cited

U.S. PATENT DOCUMENTS 4,167,460 A * 9/1979 Tomaszewski ..... C25D 3/06 205/243
5,294,326 A 3/1994 Shahin
(Continued)

FOREIGN PATENT DOCUMENTS

| | | |
|---|---|---|
| EP | 0058044 | 8/1982 |
| GB | 1431693 | 4/1976 |
| GB | 1455841 | 11/1976 |

(Continued)

OTHER PUBLICATIONS

Ferreira et al., "Electrochemical Studies of Metallic Chromium Electrodeposition From a Cr(III) Bath,," Journal of Electroanalytical Chemistry (2013), vol. 707, pp. 52-58. (Year: 2013).*

(Continued)

*Primary Examiner* — Edna Wong
(74) *Attorney, Agent, or Firm* — Smith Keane LLP

(57) ABSTRACT

There is provided an electrolyte for the electrodeposition of chromium comprising:
(A) water;
(B) at least one chromium salt; and
(C) at least one complexing agent,
wherein the molar ratio of components B:C is in the range of 1:1 to 1:50. There is also provided a method for electrodepositing chromium metal onto a conductive substrate.

15 Claims, 5 Drawing Sheets

(56) References Cited

U.S. PATENT DOCUMENTS

| | | | | |
|---|---|---|---|---|
| 2008/0169199 | A1* | 7/2008 | Huang | C25D 3/06 205/210 |
| 2017/0009361 | A1* | 1/2017 | Dal Ziliio | C25D 3/06 |

FOREIGN PATENT DOCUMENTS

| | | | |
|---|---|---|---|
| WO | 2000/056700 | A1 | 9/2000 |
| WO | 2002/026381 | | 4/2002 |
| WO | 2002/026701 | A2 | 4/2002 |
| WO | 2007/003956 | | 1/2007 |
| WO | WO2007/093574 | | 8/2007 |
| WO | 2013/182631 | | 12/2013 |

OTHER PUBLICATIONS

Chisholm et al., "Chromium-Nickel Codeposits From Dimethylformamide Baths Containing 10 Percent Water," Plating and Surface Finishing (1985), vol. 72, Issue 10, pp. 82-84. (Year: 1985).*

Zeng et al., Anti-wear properties of Cr—C and Ni—Co alloy coatings as substitutes for conventional nanocrystalline Cr coatings, Journal of Physics D: Applied Physics, 2008, 41, 185303.

Rogers et al., Ionic Liquids as Green Solvents: Progress and Prospects, ACS Symposium Series, American Chemical Society, 2003, Washington, DC.

Abbott et al., Ionic Liquid Analogues Formed from Hydrated Metal Salts, Chemistry—A European Journal, 2004, pp. 3769-3774, 10.

El-Abedin et al., Electrodeposition of Metals and Semiconductors in Air- and Water-Stable Ionic Liquids, Chemphyschem, 2006, pp. 58-61, 7.

Abbott et al., Application of ionic liquids to the electrodeposition of metals, Phys Chem Chem Phys, 2006, pp. 4265-4279, 8.

Abbott et al., Electroplating Using Ionic Liquids, Annu. Rev. Mater. Res., 2013, pp. 335-358, 43.

Ferreira et al, Electrochemical studies of metallic chromium electrodeposition from a Cr(III) bath, Journal of Electroanalytical Chemistry, 2013, pp. 52-58, 707.

Surviliene et al, Chromium electrodeposition from [BMIm][BF4] ionic liquid, Journal of Applied Electrochemistry, 2011, pp. 107-114, 41.

Eugenio et al, Electrochemical aspects of black chromium electrodeposition from 1-butyl-3-methylimidazolium tetrafluoroborate ionic liquid, Electrochimica Acta, 2011, pp. 10347-10352, 56(28).

* cited by examiner

| DES + (Current density/ $mA \cdot cm^{-2}$) | Optical image | SEM image | Cross section thickness | Hardness/ HV |
|---|---|---|---|---|
| 2urea:$CrCl_3 \cdot 6H_2O$ (200) |  |  |   | 650± 10 |
| DES + 20% $H_2O$ (122) |  |  |   | 715 ± 10 |
| DES + 0.1 M boric acid (250) |  |  |   | 610 ± 10 |
| DES + 0.1 M NaBr (250) |  |  |   | 600 ± 10 |
| DES + 20% $H_2O$ + 0.1 M boric acid (150) |  |  |   | 850+10 |
| DES + 20% $H_2O$ + 0.1 M NaBr (180) |  |  |   | 700 ± 10 |

| *DES + (Current density/ mAcm$^{-2}$)* | *Optical image* | *SEM image* | *Cross section thickness* | *Hardness/ HV* |
|---|---|---|---|---|
| 2urea: $KCr(SO_4)_2 \cdot 12 H_2O$ (150) |  |  |   | 680 ± 10 |
| DES + 20% $H_2O$ (125) |  |  |   | 700 ±10 |
| DES + 0.1 M boric acid (150) |  |  |   | 680 ± 10 |
| DES + 0.1 M NaBr (150) |  |  |   | 650 ±10 |
| DES + 20% $H_2O$ + 0.1 M boric acid (130) |  |  |   | 800 ± 10 |
| DES + 20% $H_2O$ + 0.1 M NaBr (120) |  |  |   | 780 ± 10 |

Figure 3

| Current Density / $Acm^{-2}$ | Time / mins | SEM 50 μm | Photograph |
|---|---|---|---|
| 0.3 | 30 | | |
| 0.4 | 30 | | |
| 0.3 plated for 2 minutes, polarity reversed for 30 s | 30 | | |
| 0.3 plated for 2 minutes, polarity reversed for 12 s | 30 | | |

| Current Density / $Acm^{-2}$ | Time / mins | SEM | Photograph |
|---|---|---|---|
| 0.15 | 120 |  |  |
| 0.2 | 120 |  |  |
| 0.30 | 120 |  | |

| Current Density / $Acm^{-2}$ | Time / mins | SEM | Photograph |
|---|---|---|---|
| 0.2 | 30 |  |  |
| 0.3 | 30 |  |  |

ELECTROLYTE FOR ELECTROPLATING

RELATED APPLICATIONS

The present application claims priority to co-pending PCT Application Serial No. PCT/GB2016/050248, filed on 3 Feb. 2016, entitled "Electrolyte for Electroplating," which claims priority to Great Britain Application Serial No. 1501751.0, filed 3 Feb. 2015.

BACKGROUND

This invention relates to the use of ionic liquids in electroplating, and in particular for electroplating thick, hard chromium from trivalent salts.

Electroplating is an electrodeposition process for producing a thick, uniform, and adherent coating, commonly of metal or alloys, upon a surface by the act of electric current (see, M. Kulkarni et al, *Bangladesh Journal of Scientific and Industrial Research,* 2013, 48, 205-212). The coating formed changes the properties of the underlying substrate and is generally applied to improve wear and corrosion resistance of the interface or improve the aesthetic properties of the object. The piece to be electroplated is made into the negative electrode in an electrochemical cell and a current is passed through an electrolyte containing the ions of the metal to be electrodeposited.

There has been little change in the method of electroplating over 100 years and almost all processes are based on aqueous solutions of metal salts with a variety of additives to control morphology and properties. The industry is dominated by a relatively small number of coating materials. Anti-wear coatings are mostly Cr, Ni and Co and their alloys with other metals (M. Schlesinger and M. Paunovic, *Modern Electroplating*, John Wiley & Sons, 2010; and Z. Zeng and J. Zhang, *Journal of Physics D: Applied Physics,* 2008, 41, 185303).

The use of aqueous solutions has many issues for electroplating primarily due to the narrow potential window, and so metals with a large negative reduction potentials, e.g. Cr and Zn, are deposited with poor current efficiencies and suffer from hydrogen embrittlement (A. P. Abbott and K. J. McKenzie, *Physical chemistry chemical physics:* 2006, 8, 4265-4279).

Furthermore, although water is a green solvent, the inclusion of high metal concentrations means that the water has to be extensively cleaned before it can be returned to the environment (R. D. Rogers, K. R. Seddon, A. C. S. Meeting, *Ionic Liquids As Green Solvents: Progress and Prospects*, American Chemical Society, 2003). The electroplating process is also a complex series of pre- and post-treatment steps to prepare the substrate and remove the electrolyte after coating.

There are a number of key advantages of using aqueous solutions, such as:

- Low cost
- Non-flammable
- High solubility of electrolytes
- High conductivities resulting in low ohmic losses and good throwing power
- High solubility of metal salts
- High rates of mass transfer For these reasons, water will remain the backbone of the metal plating industry. Nevertheless, there are also limitations of aqueous solutions comprising:

- Limited potential windows
- Gas evolution processes can be technically not easy to handle and results in hydrogen embrittlement
- Passivation of metals can cause issues with both anodic and cathodic materials
- Requirement for complexing agents such as cyanide
- All water must be returned to the water course These issues stop aqueous solutions being useful to the deposition of several technically vital materials. The main research areas in electroplating include replacement of environmentally toxic metal coatings (such as chromium), deposition of novel alloys and semiconductors and new coating methods for reactive metals.

Chromium plays an important role in a number of modern industries, for example, as a protective material in automotive and aerospace applications as well as for decorative purposes. It has almost unparalleled hardness and is used extensively for hydraulic systems. Chromium is traditionally electroplated from chromic acid which is a mixture of $CrO_3$ and $H_2SO_4$. Although this has been the basis of a successful technology for over 50 years it is highly toxic and carcinogenic. There has been cumulative anxiety due to environmental, health and safety concerns related with the emission, treatment, storage which has led to reduced usage of hexavalent chromium compounds (K. Legg, M. Graham, P. Chang, F. Rastagar, A. Gonzales and B. Sartwell, *Surface and Coatings Technology,* 1996, 81, 99-105).

In general, hexavalent chromium electroplating baths produce trivalent chromium ions and hydrogen gas at the cathode, whereas oxygen gas is the major product at the anode. Hexavalent chromium is strongly linked with lung cancer and it also causes burns, ulceration of the skin and the mucous membrane, and loss of respiratory sensation.

In addition to its toxicity there are other issues associated with the deposition of chromium from chromic acid electrolytes. These have been summarized by Smart et al (*Trans. Inst. Met. Finish.,* 1983, 61, 105-110) as follows:

- Chromium electrodeposition utilising Cr(VI) has a low efficiency i.e. 15-22% where the remainder of the applied current is used in hydrogen evolution.
- The average cathodic current densities are high (typically 10-15 $Adm^{-2}$).
- The procedure has poor covering power across low current density areas.
- Burning is observed as grey deposits in high current density zones.
- Chromium electroplating has low throwing power, which results in thick electrodeposits on the boundaries and protruding parts of cathodes and thin deposits over the rest of the surface.
- Breaks in power during electrodeposition produces milky deposits known as white washing.
- Chromic acid pose instant harmful effects on human tissue, burning the skin and even dilute solutions cause ulcers.
- Chromic acid is a strong oxidizing agent and hence is a fire hazard.
- High cost of chemical treatment.

Numerous studies have attempted to develop trivalent chromium formulations for chromium plating and while several have been commercialised they are all used for decorative coatings. Trivalent chromium is at least 100 times less toxic to humans and the environment than hexavalent. Thermal spray techniques, nickel-based coatings and trivalent chromium electroplating have all been used as alternatives to Cr(VI) but none have comparable hardness.

SUMMARY OF THE INVENTION

The Applicants have discovered ionic liquids which can be used to replace the typically used aqueous solutions and overcome the above identified problems. Ionic liquids can be expressed by the following equilibria;

cation+anion+complexing agent⇆cation+complex anion or potentially:

cation+anion+complexing agent⇆complex cation+anion

Type III Deep Eutectic Solvents are types of ionic liquids which do not include metallic species in the bulk liquid but use a hydrogen bond donor (HBD), such as urea or ethylene glycol to complex the anion from the salt (see, for example, Abbott et al. Novel solvent properties of choline chloride/urea mixtures. *Chem. Comm.,* 70, 2003; and Abbott et al. Deep Eutectic solvents formed between choline chloride and carboxylic acids, *J. Am. Chem. Soc.,* 26: 9142, 2004).

$$Cat^+Cl^- + HBD \rightleftharpoons Cat^+ + Cl^-.HBD$$

Deep Eutectic Solvents (DES) can be used in electroplating processes. They are simple to prepare, are insensitive to water content and do not need to be registered as their toxicological properties are known. Most importantly, for large scale applications like electroplating they are inexpensive. DES comprise of quaternary ammonium salts (e.g. choline chloride, ChCl), metal salts or metal salt hydrates and hydrogen bond donors (e.g. urea) and are commonly divided into four groups:

(i) metal salt+organic salt
(ii) metal salt hydrate+organic salt
(iii) organic salt+hydrogen bond donor
(iv) metal salt hydrate+hydrogen bond donor.

Wherein (i) describes Type I DES, (ii) describes Type II DES, (iii) describes Type III DES and (iv) describes Type IV DES.

Preferably, wherein Type I DES is a quaternary ammonium salt+metal chloride; Type II DES is a quaternary ammonium salt+metal chloride hydrate; Type III DES is a quaternary ammonium salt+hydrogen bond donor; and Type IV is a metal chloride hydrate+hydrogen bond donor.

Based on the above mentioned ionic liquids, the Applicants have surprisingly discovered an improved electrolyte for the electrodeposition of thick, hard chromium to circumvent the issues which occur when using hexavalent chromium (Cr(VI)).

According to the present invention, there is provided an electrolyte for the electrodeposition of chromium comprising:

(A) water;
(B) at least one chromium salt; and
(C) at least one complexing agent, wherein the molar ratio of components B:C is in the range of 1:1 to 1:50.

Preferably, the chromium salt is selected from at least one of $CrCl_3.6H_2O$, $KCr(SO_4)_2.12H_2O$ and $Cr_2(SO_4)_3.10H_2O$.

Optionally, the complexing agent is selected from acetamide, urea, ethylene glycol, 1,3-propanediol, 1,4-butanediol, 1,5-pentanediol, 1,6-hexanediol or glycerol.

Preferably, the complexing agent is a quaternary ammonium halide, preferably wherein the complexing agent is choline chloride.

Optionally, the electrolyte further comprises an additive selected from at least one of boric acid, lactic acid, citric acid, ethylene diamine, sodium borate, sodium citrate, sodium phosphate, nicotinic acid, dimethyl hydantoin and methyl nicotinate. Preferably, the concentration of the additive is in the range of from 0.05 to 0.5 mol $dm^{-3}$.

Optionally, the electrolyte further comprises at least one bromide or iodide salt, preferably wherein the salt is sodium iodide or lithium iodide. Preferably, wherein the salt is present is in a concentration of from 0.05 to 0.2 mol $dm^{-3}$.

Preferably, wherein the electrolyte comprises less than 50% water, preferably from 10 to 25 wt % water.

In accordance with a further aspect of the present invention, there is provided a method of electrodepositing chromium metal onto a conductive substrate comprising the steps of:

(i) contacting the substrate and a counter electrode with the electrolyte as defined herein; and
(ii) passing a current through the electrolyte to electrodeposit the chromium onto the substrate.

Preferably, the conductive substrate is selected from mild steel, copper, aluminium, stainless steel, brass, cobalt or alloys thereof.

Optionally, the current density is in the range 50 to 300 $mAcm^{-2}$.

Preferably, the electrodeposition is carried out at a temperature of between 30 and 60° C.

According to the present invention, the cathode is moved through the electrolyte during the electrodeposition process either by:

(i) rotation, wherein the rotation frequencies are in the range 0.1 to 10 Hz; or
(ii) horizontal motion, wherein the oscillation frequencies are in the range 0.1 to 10 Hz.

Preferably, the chromium deposited has a thickness of between 5 to 500 μm. Optionally, the chromium deposited has a hardness of >600 HV.

According to a further aspect of the present invention, there is provided an electroplated product comprising a conductive substrate which has been electroplated according to a method disclosed herein.

According to the present invention, there are provided electrolytes for the electrodeposition of thick, hard, chromium to circumvent the issues of using Cr(VI), to improve current efficiency and optimise the hardness and aesthetic finish of the deposit. While aqueous trivalent chromium solutions have previously been used, the deposits are usually thin (<3 μm). The present invention allows thick deposits of chromium to be formed on a substrate. Preferably, wherein the chromium has a thickness of from 5 to 500 μm.

The deposits are also hard. When using the Vickers hardness test, the chromium has a hardness >600 HV (wherein HV is the Vickers Pyramid Number). The Vickers hardness test method consists of indenting the test material with a diamond indenter, in the form of a right pyramid with a square base and an angle of 136 degrees between opposite faces subjected to a load of 1 to 100 kgf. The full load is normally applied for 10 to 15 seconds.

The Applicants have found that by using the electrolyte according to the present invention, amorphous crack-free chromium deposits were obtained. The black coatings produced had a similar appearance to 'Black Chrome' coatings produced from sulfate-free hexavalent aqueous solutions.

Furthermore, the coating thicknesses were greater than those obtained from aqueous baths.

In a preferred embodiment, the electrolyte comprises three components; water, a chromium salt and a complexing agent. Additional additives can optionally be used to improve brightness, adhesion and process operating conditions.

Component A:

Water is the minor component (by mass) but plays the role of controlling speciation of the chromium complex. While chromium can be deposited in the absence of water the optimum morphology and hardness are obtained with between 10 and 25 wt % water, preferably with 20% water. The water controls the chromium salt speciation and cationic metal complexes are important. Mass transport to and from the electrode surface is vital and water controls the viscosity of the liquid.

Component B:

Is a chromium salt. Preferably the chromium salt is selected from $CrCl_3.6H_2O$, $KCr(SO_4)_2.12H_2O$ and $Cr_2(SO_4)_3.10\ H_2O$.

Component C:

This component is a complexing agent which interacts with the chromium salt affecting speciation. The complexing agent can be an amide, such as urea or acetamide, a glycol such as glycerol or a quaternary ammonium halide such as choline chloride. Preferably, Component C is in molar excess of Component B.

Preferably, the molar ratio of Component B:C should optimally be in the range 1:1 to 1:50, preferably 1:1.5 to 1.3.

The electrolyte can optionally comprise additives, which are common in metal plating systems and can modify mass transport, speciation or adsorption at the electrode surface. Preferably, the additives are selected from those which improve deposit morphology, by adsorbing at the electrode/solution interface. Preferably, the additive is selected from at least one of boric acid, lactic acid, citric acid, ethylene diamine, sodium borate, sodium citrate, sodium phosphate, nicotinic acid, dimethyl hydantoin and methyl nicotinate. The optimum concentration for these additives is in the range 0.05 to 0.5 mol $dm^{-3}$.

In the absence of additives the anodic reaction on a dimensionally stable anode will be a mixture of oxygen evolution (from decomposition of water) and chlorine evolution from the oxidation of chloride. The latter is clearly undesirable due to its toxicity and the large overpotential required to drive the reaction at a suitable rate to support metal deposition at the cathode. To circumvent these issues bromide or iodide salts with cations can be added in the concentration range 0.05 to 0.2 mol $dm^{-3}$. Preferably, wherein the salt is sodium iodide, sodium chloride or lithium iodide.

The anodic products $Br_2Cl^-$ and $I_2Cl^-$ are soluble in the liquid due to the high ionic strength. The lower overpotential required to oxidise bromide or iodide, decreases the deposition potential and increase the current density that can be achieved. Incorporation of chromium metal in the form of lumps or course powder close to the anode will allow the $Br_2Cl^-$ or $I_2Cl^-$ to oxidise the metal and maintain a roughly constant chromium content in the electroplating electrolyte. The role of additives in controlling morphology can be seen clearly in FIGS. 1 and 2.

DETAILED DESCRIPTION AND BRIEF DESCRIPTION OF THE DRAWINGS

FIG. 3 shows the effect of current density and potential pulse sequences on deposit morphology.

Figure 1:
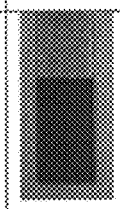
FIG. 1 shows an optical photograph, SEM image, thickness cross section and plating conditions of chromium deposit obtained from the electroreduction of 2 urea: $CrCl_3.6H_2O$ with and without additives, for 1 hour at 40° C. and 4-5 V.
Figure 1:
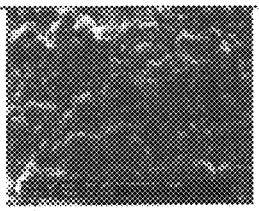
Figure 1:
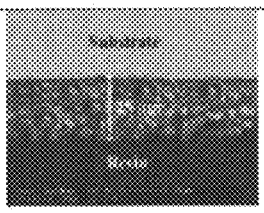
Figure 1:
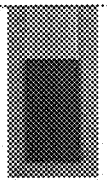
Figure 1:
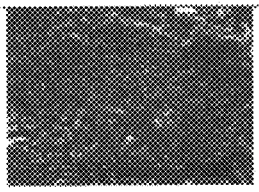
Figure 1:
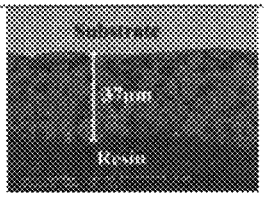
Figure 1:
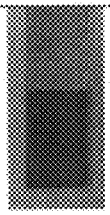
Figure 1:
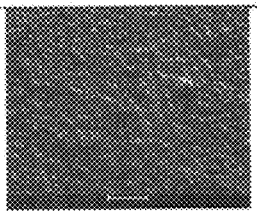
Figure 1:
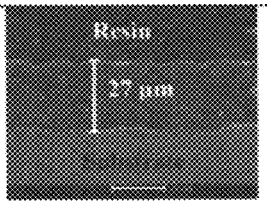
Figure 1:
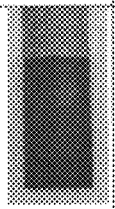
Figure 1:
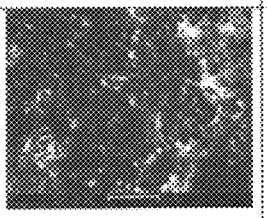
Figure 1:
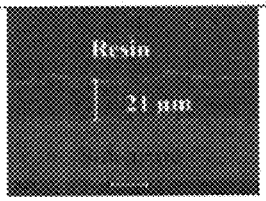
Figure 1:
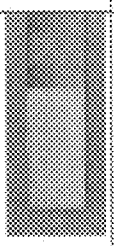
Figure 1:
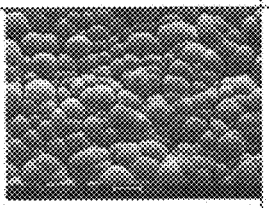
Figure 1:
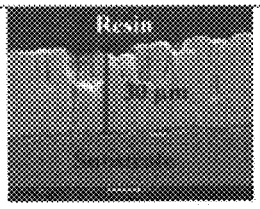
Figure 1:
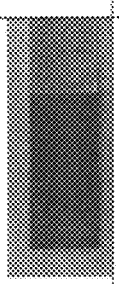
Figure 1:
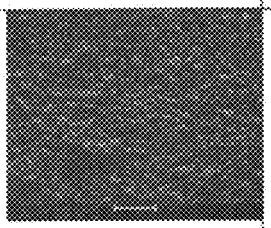
Figure 1:
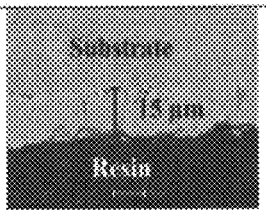
Figure 2:
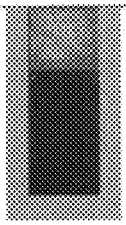
FIG. 2 shows an optical photograph, SEM image, thickness cross section and plating conditions of chromium deposit obtained from the electroreduction of 2 urea: $KCr(SO_4)_2.12H_2O$ with and without additives, for 1 hour at 40° C. and 4-5 V.
Figure 2:
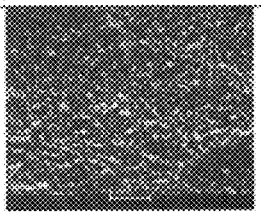
Figure 2:
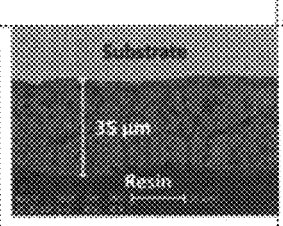
Figure 2:
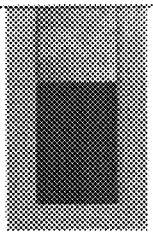
Figure 2:
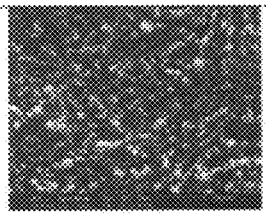
Figure 2:
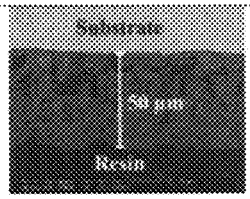
Figure 2:
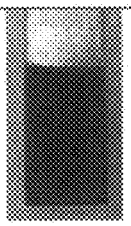
Figure 2:
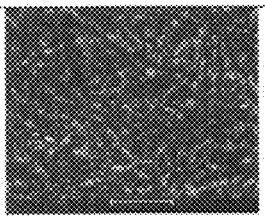
Figure 2:
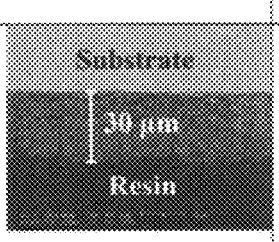
Figure 2:
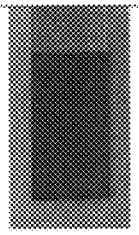
Figure 2:
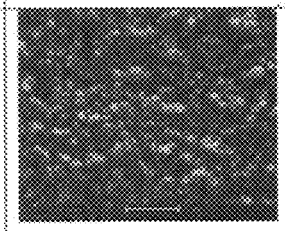
Figure 2:
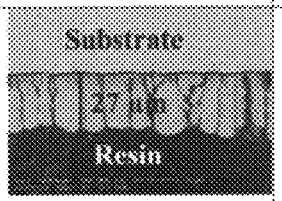
Figure 2:
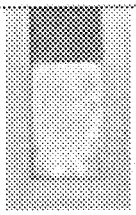
Figure 2:
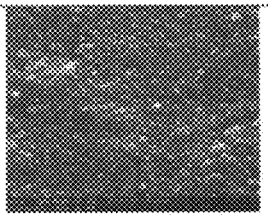
Figure 2:
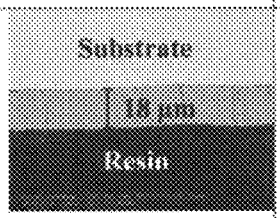
Figure 2:
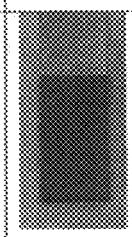
Figure 2:
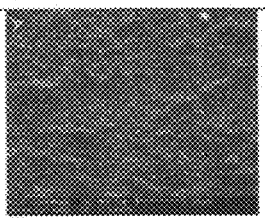
Figure 2:
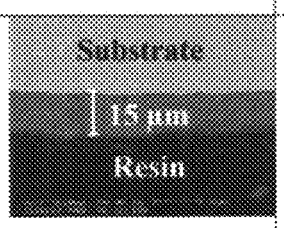

The optimum current density is in the range 50 to 300 $mAcm^{-2}$.

The temperature can affect speciation and mass transport. The temperature at which the above-described electrodeposition methods are conducted may be, for example, any temperature between 20 and 60° C. The optimum temperature is between 30 and 60° C.

Mass transport is vital in controlling morphology and optimum hardness and appearance are obtained when the cathode is moved through the electrolyte during the electrodeposition process. Movement is controlled by rotation (where rotation frequencies are in the range 0.1 to 10 Hz) or horizontal motion (where oscillation frequencies are in the range 0.1 to 10 Hz). This replenishes the electrolyte close to the electrode surface.

In relation to the above-described electrodeposition method, the conductive substrate may be any suitable solid, conductive material such as mild steel, copper, aluminium, stainless steel, brass, cobalt or alloys thereof.

Further, the reducing potential applied to the conductive substrate may be, for example, a constant potential. Alternatively, the deposition can be achieved by utilising a constant current. The current density is calculated based on the size of the substrate which is being plated.

In particular embodiments of the invention, the electrodeposition in the above-described methods is conducted under an inert atmosphere (e.g. under an atmosphere of argon or, particularly nitrogen).

In a preferred embodiment, the electrolyte comprises 20 wt % water $1CrCl_3.6H_2O$ and 2ChCl.

As discussed above, deposit morphology can be significantly affected by mass transport. By mechanically moving the sample in the solution this provides better deposit morphology and improved hardness.

In an experiment, the plating was conducted from 40 litres volume of Chromline 50 (20% $H_2O$ w/w) with 0.1 M NaBr and 0.1 M $H_3BO_3$. The conditions were as follows:

One cathode—mild steel plate (1 mm thickness for all samples)

Two anodes—$IrO_2$ coated Ti mesh (Electrode area=1056 $cm^2$), anode/cathode distance was 13 cm Bath temperature was at 40 (±3)° C.

Plated sample was moved laterally at ca. 0.5 Hz frequency

Examples of deposits obtained by this process are shown in FIG. 3. Pulsing the applied potential also affected the deposit morphology as shown in FIG. 3.

Figure 4:
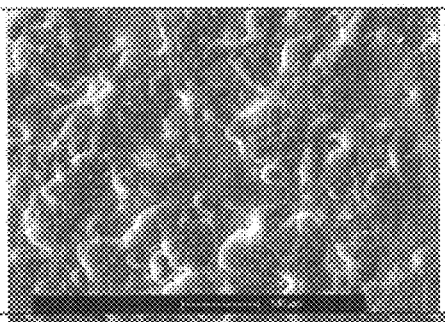
FIG. 4 shows the effect of current density on deposit morphology obtained in a flow cell with a flow rate of 72.2 $cm^3/s$.
Figure 4:
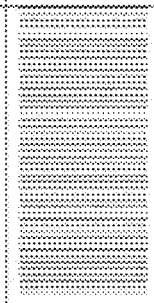
Figure 4:
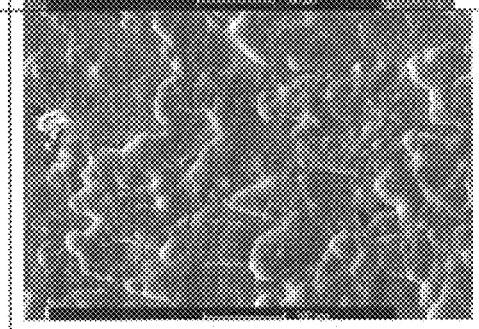
Figure 4:
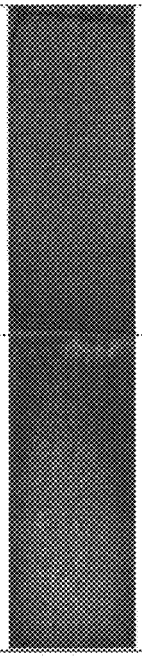
Figure 4:
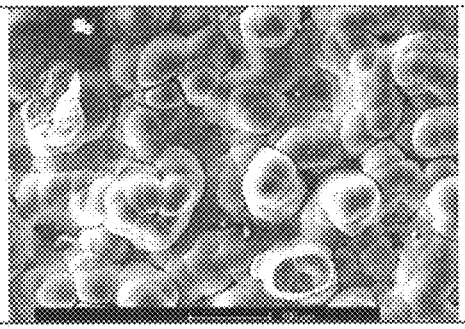

A flow cell can also improve deposit morphology and thickness at lower current densities, as shown in FIG. 4.

In a further experiment, the plating was conducted from 11.8 litres volume of Chromline 50 (20% $H_2O$ w/w) in a flow cell. The conditions were as follows:

One cathode—mild steel plate (1 mm thickness for all samples)

One anode—$IrO_2$ coated Ti mesh (EA 35=$cm^2$), anode/cathode distance set at 3.6 cm Reaction temperature was controlled at 38 (±4)° C.

Voltage was at 15 (±4) V but lower current densities were required

Flow rate was at 72.2 $cm^3/s$

The adhesion of the chromium layer onto a mild steel substrate can also be dependent upon the pre-treatment protocol. A suitable protocol to achieve effective degreasing involves the following process.

Degrease for 1 minute in hexane at room temperature with stirring

Degrease for 10 minutes in Anapol C with stirring at 60° C.

Rinse with water

Rinse with acetone

Dry with compressed air

Figure 5:
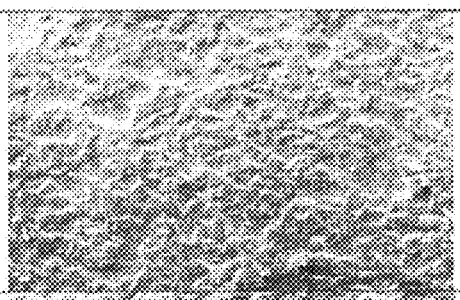
FIG. 5 shows the effect of current density on the deposit morphology obtained using the flow cell with a flow rate of 72.2 $cm^3/s$ using chrome alum:urea:water based eutectic.
Figure 5:
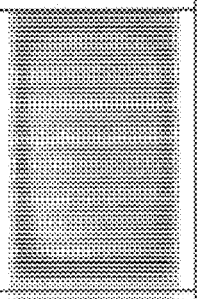
Figure 5:
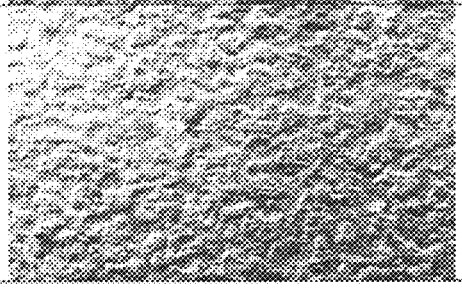
Figure 5:
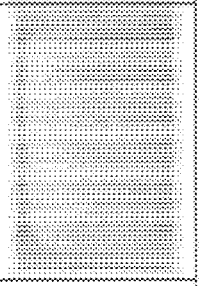

The use of chrome alum based liquids with water produces coatings with less cracks and a harder surface (see FIG. 5). In a further experiment, the plating was conducted from 0.3 litres volume of chrome alum/urea DES with 30% weight water. The conditions were as follows:

One cathode—mild steel plate (1 mm thickness for all samples)

One anode—$IrO_2$ coated Ti mesh (area=4 $cm^2$), anode/cathode distance was 2.5 (±0.2) cm Reaction temperature was controlled at 17 (±2)° C.

Carried out in the same cell flow cell as discussed above.

The invention claimed is:

1. An electrolyte for the electrodeposition of chromium comprising:

(A) less than 50 wt % water;

(B) at least one chromium salt; and (C) at least one complexing agent selected from the group consisting of acetamide, urea, ethylene glycol, 1,3-propanediol, 1,4-butanediol, 1,5-pentanediol, 1,6-hexanediol and glycerol, wherein the molar ratio of components B:C is in the range of 1:1 to 1:50.

2. The electrolyte according to claim 1, wherein the chromium salt comprises at least one salt selected from the group consisting of $CrCl_3.6H_2O$, $KCr(SO_4)_2.12H_2O$ and $Cr_2(SO_4)_3.10H_2O$.

3. The electrolyte according to claim 1 further comprising an additive comprising at least one selected from the group consisting of boric acid, lactic acid, citric acid, ethylene diamine, sodium borate, sodium citrate, sodium phosphate, nicotinic acid, dimethyl hydantoin and methyl nicotinate.

4. The electrolyte according to claim 3 wherein the concentration of the additive is in the range of from 0.05 to 0.5 mol $dm^{-3}$.

5. The electrolyte according to claim 1 further comprising at least one bromide or iodide salt.

6. The electrolyte according to claim 5 wherein the salt is present is in a concentration of from 0.05 to 0.2 mol $dm^{-3}$.

7. The electrolyte according to claim 5, wherein the salt is sodium iodide or lithium iodide.

8. A method comprising the steps of:

(i) contacting a conductive substrate and a counter electrode with the electrolyte as defined in claim 1; and (ii) passing a current through the electrolyte to electrodeposit chromium metal onto the conductive substrate.

9. The method according to claim 8 wherein the conductive substrate comprises a material selected from the group consisting of mild steel, copper, aluminium, stainless steel, brass, cobalt and alloys thereof.

10. The method according to claim 8 wherein the current has a density in the range 50 to 300 $mAcm^{-2}$.

11. The method according to claim 8 wherein the electrodeposition is carried out at a temperature of between 30 and 60° C.

12. The method according to claim 8 further comprising the step of:

moving the conductive substrate through the electrolyte either by (i) rotation, wherein the rotation frequencies are in the range 0.1 to 10 Hz; or (ii) oscillating horizontal motion, wherein the oscillation frequencies are in the range 0.1 to 10 Hz.

13. The method according to claim 8 wherein the chromium metal electrodeposited during the passing step has a thickness of 5 to 500 μm.

14. The method according to claim 8 wherein the chromium metal electrodeposited during the passing step has a hardness greater than 600 HV.

15. The electrolyte according to claim 1, wherein the electrolyte comprises from 10 to 25 wt % water.

* * * * *